United States Patent [19]

Nakaniwa et al.

[11] Patent Number: 4,986,245

[45] Date of Patent: Jan. 22, 1991

[54] CONTROL SYSTEM FOR INTERNAL COMBUSTION ENGINE WITH IMPROVED TRANSITION CHARACTERISTICS

[75] Inventors: Shinpei Nakaniwa; Masuo Kashiwabara, both of Gunma, Japan

[73] Assignee: Japan Electronic Control Systems Company, Limited, Isezaki, Japan

[21] Appl. No.: 268,560

[22] Filed: Nov. 8, 1988

[30] Foreign Application Priority Data

Nov. 10, 1987 [JP] Japan ..... 62-281963

[51] Int. Cl.[5] ..... F02D 41/10; F02D 43/04

[52] U.S. Cl. ..... 123/492; 123/417; 123/491

[58] Field of Search ..... 123/492, 493, 491, 418, 123/417, 416, 480, 478

[56] References Cited

U.S. PATENT DOCUMENTS

| | | | |
|---|---|---|---|
| 4,425,890 | 1/1984 | Yamaguchi | 123/418 |
| 4,442,812 | 4/1984 | Mizuno et al. | 123/491 |
| 4,454,847 | 6/1984 | Isomura et al. | 123/492 |
| 4,463,731 | 8/1984 | Matsuoka | 123/492 |

FOREIGN PATENT DOCUMENTS

| | | |
|---|---|---|
| 0196657 | 10/1986 | European Pat. Off. . |
| 58-144636 | 8/1983 | Japan . |
| 58-144637 | 8/1983 | Japan . |
| 59-101556 | 6/1984 | Japan . |
| 59-145364 | 8/1984 | Japan . |
| 60-35145 | 2/1985 | Japan . |
| 60-60234 | 4/1985 | Japan . |
| 61-25942 | 2/1986 | Japan . |
| 62-113836 | 5/1987 | Japan . |

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

An engine control system derives a basic fuel supply amount on the basis of preselected parameters including an intake air volume associated value and modifies the derived basic fuel supply amount in such a manner that the modified fuel supply amount becomes equal to the basic fuel supply amount derived on the basis of the preselected parameters when the engine is not in an acceleration state satisfying a predetermined first condition, and the modified fuel supply amount varies at a greater rate than variation rate of the basic fuel supply amount derived on the basis of the preselected parameters when the engine is in the accelerating state satisfying the predetermined first condition. The basic fuel supply amount as modified may be further modified with a correction value during the engine accelerating state satisfying a predeermined second condition. The engine control system may further perform a spark ignition timing control system in which the spark ignition timing is determined with taking the modified fuel supply amount as an engine load representative data.

29 Claims, 5 Drawing Sheets

CONTROL SYSTEM FOR INTERNAL COMBUSTION ENGINE WITH IMPROVED TRANSITION CHARACTERISTICS

BACKGROUND OF THE INVENTION

1. Field of the Invention

The present invention relates generally to a control system for an internal combustion engine, such as for an automotive internal combustion engine. More specifically, the invention relates to an engine control system which is applicable for L-Jetronics type control system, in which an engine load representative parameter is generally monitored by means of an air flow meter, for D-Jetronics type control system, in which an engine load representative parameter is generally monitored by means of a pressure sensor monitoring an intake air pressure in an air induction system, and for so-called −N type control system, in which an engine load representative parameter is monitored by means of a throttle valve angle sensor and which can improve transition control characteristics for improving transition response ability, precision in air/fuel ratio, optimizing spark ignition timing and so forth.

2. Description of the Background Art

In one of the typical known engine control system employs an intake air pressure as an engine load representative parameter. A basic fuel supply amount, e.g. fuel injection amount, is derived on the basis of an engine load data derived on the basis of the intake air pressure, and an engine speed data. The basic fuel supply amount is corrected with a various correction coefficients, such as an engine coolant dependent correction coefficient and so forth. By correcting the basic fuel supply amount with correction coefficients, fuel supply amount is derived.

In addition, correction for the basic fuel supply amount is performed in response to acceleration and deceleration demand in engine transition condition. An acceleration and deceleration fuel supply correction coefficient is generally derived on the basis of a magnitude of variation of a throttle valve open angle.

In practice, the correction coefficient for correcting the basic fuel supply amount is derived by multiplying an acceleration and deceleration dependent correction coefficient which is derived by map look-up performed in terms of a throttle valve angular position variation rate; an engine load dependent correction coefficient derived by map look-up in terms of the basic fuel supply amount, an engine speed dependent correction coefficient derived by map look-up in terms of an engine speed; a throttle valve open angle dependent correction coefficient derived by map look-up in terms of a throttle valve open angle and an engine coolant temperature dependent correction coefficient by map look-up in terms of an engine coolant temperature.

Even in such conventional fuel supply control system, an engine acceleration characteristics tends to be degraded due to lag in compensation of required amount of fuel for making the internal periphery of an intake manifold of an air induction system wet. As a result, air/fuel mixture at the initial period in engine acceleration becomes lean to lower engine performance. In addition, the acceleration and deceleration dependent correction coefficient map is difficult to set in a map over all of the engine driving condition. Furthermore, in order to establish correction coefficient map for deriving the acceleration and deceleration dependent correction coefficient, substantial work should be done with respect to each individual engine for achieving precise acceleration and deceleration transition control. This increases cost for establishing the map and whereby cause substantial increase of the overall cost for establishing the control system.

SUMMARY OF THE INVENTION

Therefore, it is an object of the invention to provide an engine control system which can improve engine response characteristics in an engine transition, such as in an engine acceleration and deceleration.

In order to accomplish aforementioned and other objects, an engine control system according to the present invention, derives a basic fuel supply amount on the basis of preselected parameters including an intake air volume associated value and modifies the derived basic fuel supply amount in such a manner that the modified fuel supply amount becomes equal to the basic fuel supply amount derived on the basis of the preselected parameters when the engine is not in an acceleration state satisfying a predetermined first condition, and the modified fuel supply amount varies at a greater rate than variation rate of the basic fuel supply amount derived on the basis of the preselected parameters when the engine is in the accelerating state satisfying the predetermined first condition. The basic fuel supply amount as modified may be further modified with a correction value during the engine accelerating state satisfying a predetermined second condition.

The invention further provides a spark ignition timing control system in which the spark ignition timing is determined with taking the modified fuel supply amount as an engine load representative data.

According to one aspect of the invention, a control system for an internal combustion engine, comprises:

a first sensor means for monitoring an engine driving condition to produce data representative of an engine driving condition;

second means for deriving a basic fuel supply amount on the basis of the engine driving condition indicative data;

third means for detecting an engine transition state;

fourth means, responsive to the third means detecting the engine transition state, for modifying the basic fuel supply amount with a given engine transition state correction value;

fifth means for setting a fuel supply amount, the fifth means operating in a first mode for deriving the fuel supply amount on the basis of the basic fuel supply amount derived by the second means and in a second mode, in response to the third means detecting the engine transition state, for deriving the fuel supply amount on the basis of the basic fuel supply amount modified by the fourth means; and sixth means for performing fuel supply for a controlled amount of fuel corresponding to the fuel supply amount set by the fifth means.

According to another aspect of the invention, a fuel injection control system for an internal combustion engine, comprises:

a first sensor means for monitoring an engine driving condition including a first parameter representative of an intake air related engine load and a second parameter representative of a fuel injection amount correction factor to produce data representative of an engine driving condition;

second means for deriving a first basic fuel injection amount on the basis of the first parameter;

third means for performing weighing process for the basic fuel injection amount with a predetermined weighing coefficient in order to derive a second basic fuel injection amount fourth means for detecting an engine acceleration transition state;

fifth means, responsive to the third means detecting the engine transition state, for setting an initial value of an engine acceleration transition state correction value which is gradually decreased to zero so as to modify the basic fuel injection amount with the engine transition state correction value to derive a third basic fuel injection amount;

sixth means for setting a fuel injection amount, the fifth means operating in a first mode for deriving the fuel injection amount on the basis of the second basic fuel injection amount derived by the third means and in a second mode, in response to the fourth means detecting the engine acceleration transition state, for deriving the fuel injection amount on the basis of the third basic fuel injection amount; and sixth means for performing fuel injection for a controlled amount of fuel corresponding to the fuel injection amount set by the fifth means.

According to a further aspect of the invention fuel injection control system for an internal combustion engine, comprises:

a first sensor means for monitoring an engine driving condition including a first parameter representative of an intake air pressure and a second parameter representative of a fuel injection correction factor to produce data representative of an engine driving condition;

second means for deriving a first basic fuel injection amount on the basis of the first parameter and a correction value derived on the basis of second parameter;

third means for performing weighing process for the basic fuel injection amount with a predetermined weighing coefficient in order to derive a second basic fuel injection amount, the third means being responsive to an engine acceleration state for increasing the value of the second basic fuel injection amount in a greater rate than the increasing rate of the value of the first basic fuel injection amount fourth means for detecting an engine acceleration transition state from the engine accelerating state to a steady state;

fifth means, responsive to the third means detecting the engine transition state, for setting an initial value of an engine acceleration transition state correction value which is gradually decreased to zero so as to modifying the basic fuel injection amount with the engine transition state correction value to derive a third basic fuel injection amount;

sixth means for setting a fuel injection amount, the fifth means operating in a first mode for deriving the fuel injection amount on the basis of the second basic fuel injection amount derived by the third means and in a second mode, in response to the fourth means detecting the engine acceleration transition state, for deriving the fuel injection amount on the basis of the third basic fuel injection amount; and sixth means for performing fuel injection for a controlled amount of fuel corresponding to the fuel injection amount set by the fifth means.

Preferably, the fifth means sets the initial value of the engine acceleration transition state correction value at a value corresponding to a difference between a maximum value of the second basic fuel injection amount and an instantaneous value of the first basic fuel injection amount upon detection of the engine acceleration transition state.

The third means may arithmetically derive the second basic fuel injection amount in such a manner that the second basic fuel injection amount becomes equal to the first basic fuel injection amount while a difference between the instantaneous first basic fuel injection amount and a preceding first basic fuel injection amount derived in an immediately preceding cycle is zero, and that the second basic fuel injection amount varies in a greater magnitude than that of the first basic fuel injection amount when the difference between the instantaneous basic first fuel injection amount and the preceding first basic fuel injection amount greater than zero.

In practice, the weighing coefficient is variable depending upon an engine coolant temperature and/or depending upon the first parameter.

The sixth means may detect an engine start-up condition on the basis of the engine driving condition indicative sensor signal for utilizing the basic fuel injection representative data as the basic fuel injection amount for deriving the fuel injection amount.

According to a still further aspect of the invention, a spark ignition timing control system for an internal combustion engine, comprises:

a first sensor means for monitoring an engine driving condition including a first parameter representative of an intake air pressure, a second parameter representative of an engine speed and a third parameter representative of a preselected correction factor to produce data representative of an engine driving condition;

second means for deriving a first basic fuel injection amount on the basis of the first parameter and a correction value derived on the basis of third parameter;

third means for performing weighing process for the basic fuel injection amount with a predetermined weighing coefficient in order to derive a second basic fuel injection amount, the third means being responsive to an engine acceleration state for increasing the value of the second basic fuel injection amount in a greater rate than the increasing rate of the value of the first basic fuel injection amount and fourth means for setting a spark ignition timing on the basis of the first basic fuel injection amount as an engine load representative parameter and the second parameter monitored by the first sensor means.

According to a yet further aspect of the invention, a control system for an internal combustion engine, comprising:

a first sensor means for monitoring an engine driving condition including a first parameter representative of an intake air pressure and a second parameter representative of an engine speed, and a third parameter representative of a preselected fuel supply correction factor to produce data representative of an engine driving condition;

second means for deriving a first basic fuel supply amount on the basis of the first parameter and a correction value derived on the basis of third parameter;

third means for performing weighing process for the basic fuel supply amount with a predetermined weighing coefficient in order to derive a second basic fuel supply amount, the third means being responsive to an engine acceleration state for increasing the value of the second basic fuel supply amount in a greater rate than the increasing rate of the value of the first basic fuel supply amount fourth means for detecting an engine transition state fifth means, responsive to the fourth means detecting the engine transition state, for modifying the second basic fuel supply amount with a given engine transition state correction value to derive a third basic fuel supply amount;

sixth means for setting a fuel supply amount, the fifth means operating in a first mode for deriving the fuel supply amount on the basis of the second basic fuel supply amount and in a second mode which is triggered in response to the third means detecting the engine transition state, for deriving the fuel supply amount on the basis of the third basic fuel supply amount;

sixth means for performing fuel supply for a controlled amount of fuel corresponding to the fuel supply amount set by the fifth means.

seventh means for setting a spark ignition timing on the basis of the first basic fuel injection amount as an engine load representative parameter and the second parameter monitored by the first sensor means.

BRIEF DESCRIPTION OF THE DRAWINGS

The present invention will be described in detail herebelow with reference to the accompanying drawings of the preferred embodiment of the invention, which, however, should not be taken to limit the invention to the specific embodiment, but are for explanation and understanding only.

In the drawings.

DESCRIPTION OF THE PREFERRED EMBODIMENT

Figure 1:
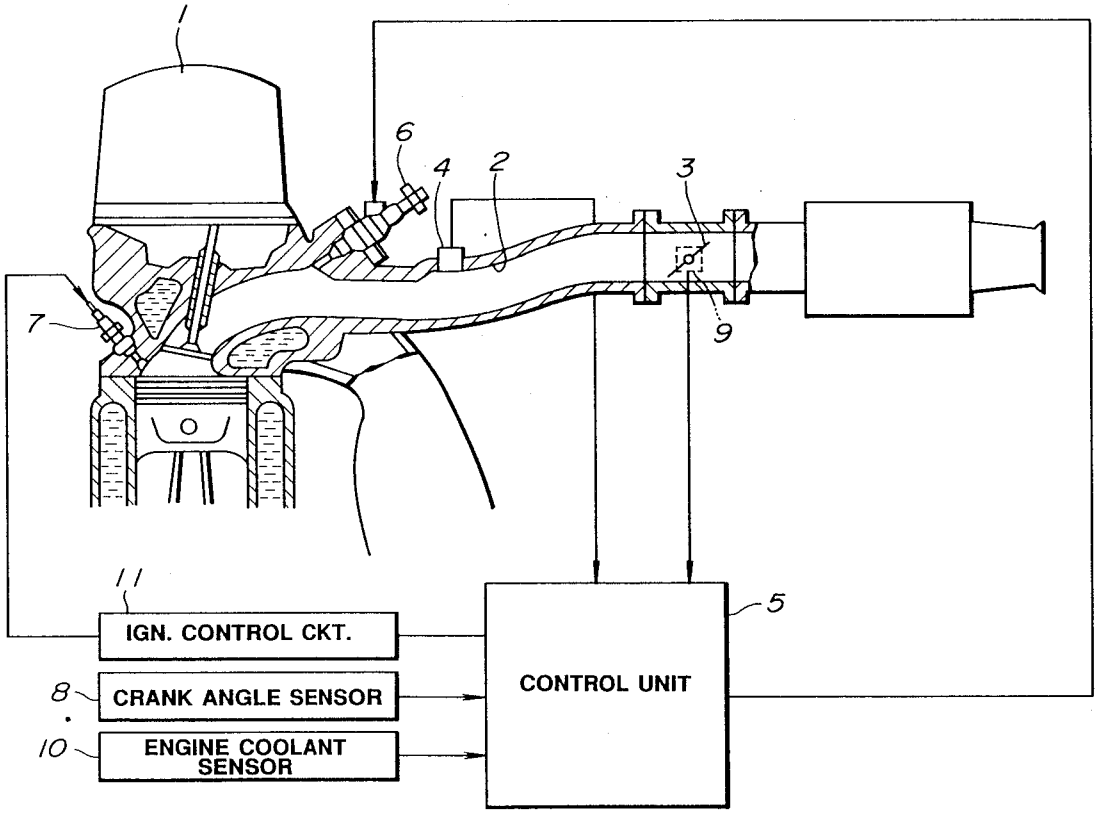
FIG. 1 is a schematic block diagram of the preferred embodiment of an engine control system according to the present invention.

Referring now to the drawings, particularly to FIG. 1, the preferred embodiment of an engine control system according to the present invention, will be discussed herebelow in terms of a D-Jetronics type fuel injection internal combustion engine.

As is well known, a fuel injection internal combustion engine 1 has an air induction system 2, in which a throttle valve 3 is disposed for adjusting an intake air flow rate to be supplied to the engine. An intake air pressure sensor 4 is provided in the induction system 2. As seen from FIG. 1, the intake air pressure sensor 4 is provided at a position downstream of the throttle valve 3 to monitor intake air pressure as a basic engine load indicative parameter, and produces an intake air pressure indicative sensor signal $S_{PB}$. The intake air pressure indicative sensor signal $S_{PB}$ is input to a control unit 5. The control unit 5 is also connected to a fuel injection valve 6. The fuel injection valve 6 is disposed within an intake manifold of the air induction system 2 for injecting a controlled amount of fuel toward an intake air flowing therethrough. The control unit 5 controls the fuel injection valve 6 to perform fuel injection for injecting the controlled amount of fuel at a controlled timing.

The control unit 6 is further connected to an engine coolant temperature sensor 10 which is disposed within an engine coolant passage defined in an engine block to monitor a temperature of an engine coolant flowing therethrough and produces an engine coolant temperature indicative sensor signal $S_{TW}$. As will be appreciated that the engine coolant temperature as monitored by the engine coolant temperature sensor 7 is one of the typical correction parameter for correcting a basic fuel injection amount which will be discussed later. The control unit 6 is also connected to a crank angle sensor 8 which is associated with a crankshaft (not shown) or a distributor (not shown). The crank angle sensor 8 monitors crank shaft angular position and produces a crank reference signal $\theta_{ref}$ at every predetermined angular position of the crankshaft and a crank position signal $\theta_{pos}$ at every given angle, i.e. 1°, of crankshaft angular displacement. The control unit 6 derives an engine speed data N on the basis of the crank reference signal $\theta_{ref}$ or the crank position signal $\theta_{ref}$ in per se well known manner.

Namely, when the crank reference signal $\theta_{ref}$ is used for deriving the engine speed data N, an interval of occurrences of the crank reference signals is measured. The engine speed data N is produced by obtaining reciprocal of the measured interval. In the alternative, when the engine speed data N is derived on the basis of the crank position signal $\theta_{pos}$, the crank position signal is counted within a given period or the period is measured count the given number of crank position signal.

In addition, the control unit 6 is connected to a throttle angle sensor 9 which monitors the angular position of the throttle valve 3 and produces a throttle valve angular position indicative signal $S\alpha$. Furthermore, other sensors or switches may be connected to the control unit 6 for inputting various correction parameter for correcting the basic fuel injection amount. Also, the control unit 6 may connected to an ignition control circuit 11 including an ignitor, an ignition coil and ignition power distributing unit, such as a mechanical or electrical distributor. The ignition control circuit 11 is connected to an ignition plug 7 inserted into each engine cylinder for performing spark ignition at a controlled timing.

Figure 2:
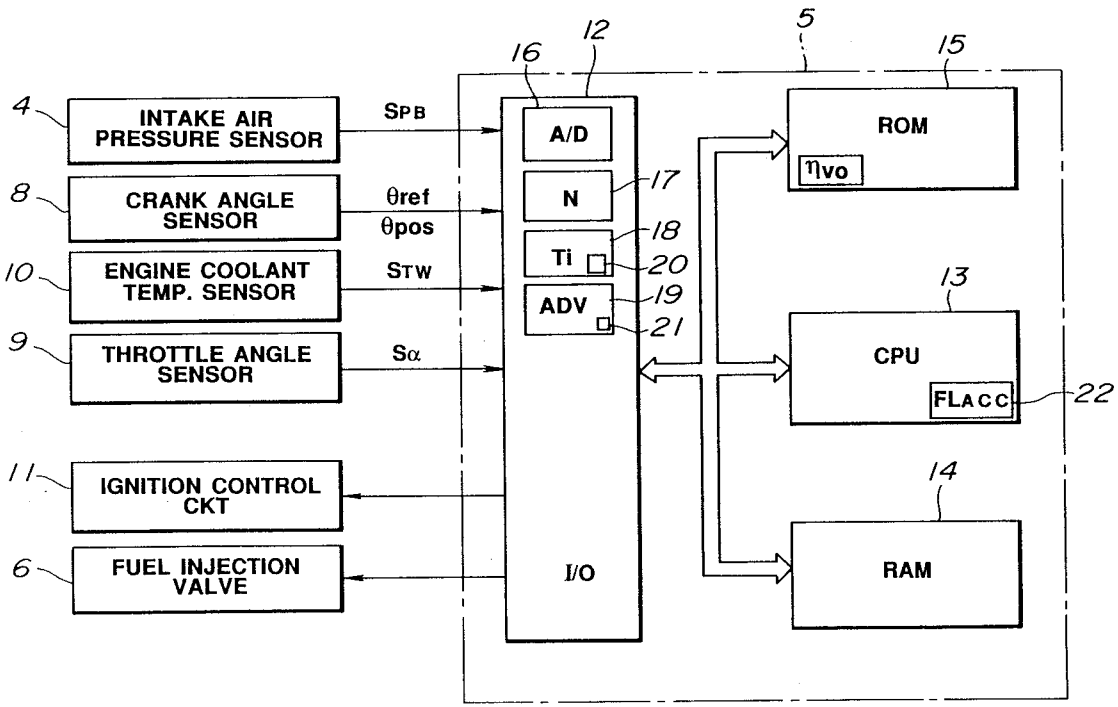
FIG. 2 is a block diagram of the preferred embodiment of a control unit employed in the preferred embodiment of the engine control system of FIG. 1.

As seen from FIG. 2 , the control unit 6 generally comprises a microprocessor including an input/output interface 12, CPU 13, RAM 14 and ROM 15. The input/output interface may includes an analog-to-digital (A/D) converter 16 for converting analog sensor signals, such as the intake air pressure indicative sensor signal $S_{PB}$ of the intake air pressure sensor 4, the engine coolant temperature indicative signal $S_{Tw}$ of the engine coolant temperature sensor 10 and the throttle angle indicative signal $S\alpha$ of the throttle angle sensor 9. The intake air pressure indicative analog sensor signal $S_{PB}$ is coverted into an intake pressure indicative data PB. Similarly, the engine coolant indicative sensor signal $S_{Tw}$ is converted into the digital form engine coolant temperature data Tw. Also, the throttle angle indicative signal $S\alpha$ is converted into a throttle angle indicative data $\alpha$ in a digital form. The input/output interface 12 may also incorporate an engine speed derivation circuit 17 for deriving the engine speed data N on the basis of the crank reference signal $\theta_{ref}$ or the crank position signal $\theta_{pos}$. The input/output interface 12 further incorporates a fuel injection control section 18 and a spark ignition timing control register 19. The fuel injection control section includes a Ti register 20 to which a fuel injection amount indicative data Ti is to be set. Similarly, the spark ignition timing control section 19 has a ADV register 21 to which a spark advance indicative data ADV is to be set.

Figure 6:
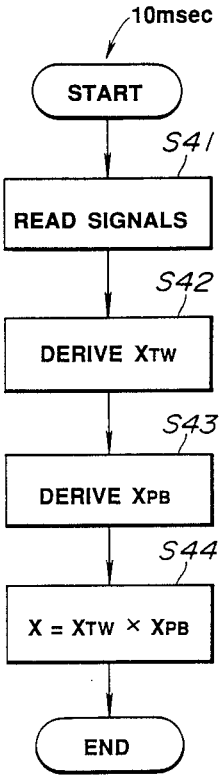
FIG. 6 is a flowchart of a routine for deriving a weighing correction coefficient.

Further detailed construction of the control unit 6 will be discussed with the preferred process of engine control which is to be implemented by the shown embodiment of the engine control system of FIGS. 1 and 2. The process will be discussed with reference to FIGS. 3 and 6. The routines illustrated in FIGS. 3 and 6 are stored in ROM 15 and governed by a main program which is executed as a background job.

Figure 3:
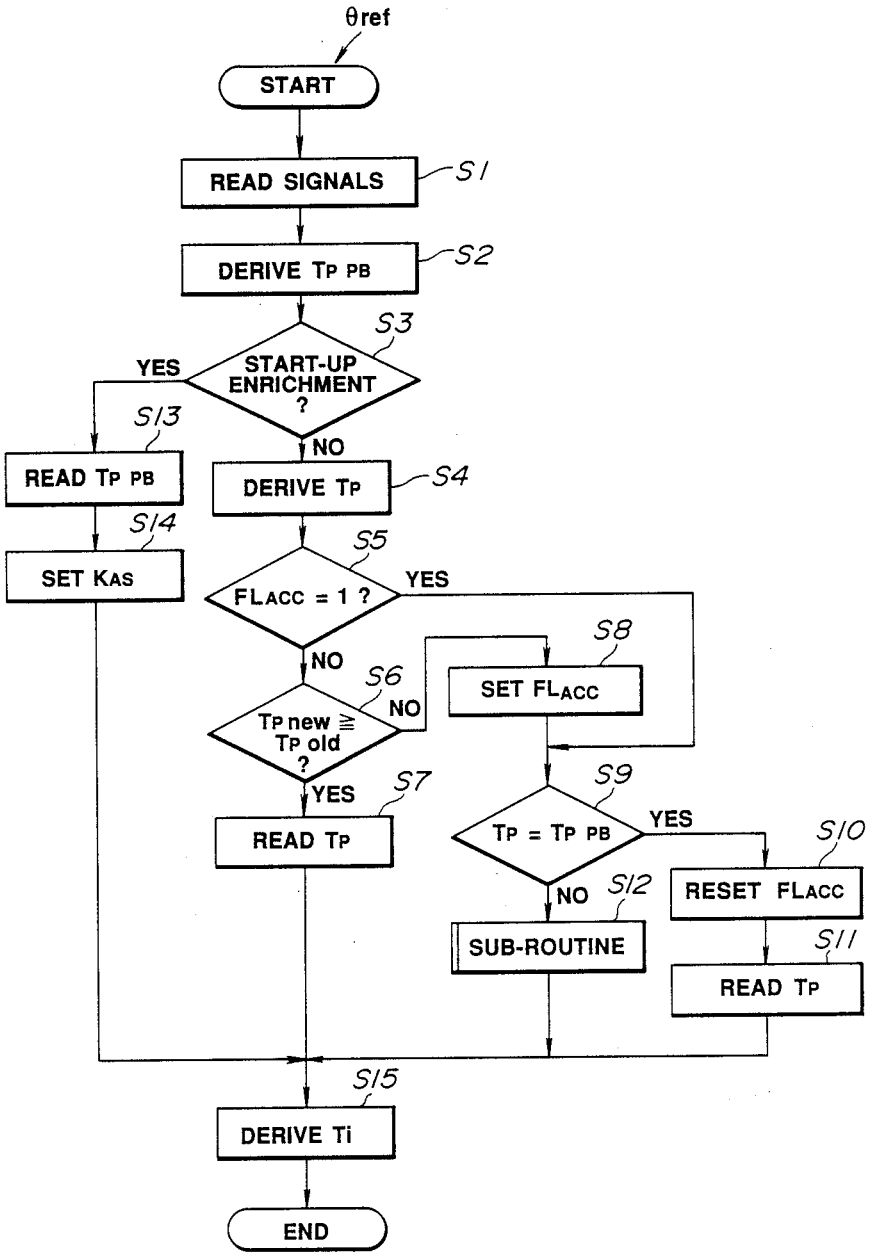
FIG. 3 is a flowchart of a routine for setting a fuel injection amount Ti for performing fuel injection control.

The routine shown in FIG. 3 is a fuel injection amount derivation routine which is programed to be executed interrupting the background job at every occurrence of the crank reference signal $\theta_{ref}$. Therefore, the fuel injection amount derivation routine of FIG. 3 is executed every 120° (in case of 6-cylinder engine) or 180° (in case of 4-cylinder engine), in practice.

As a step S1, fuel injection control parameters, including the engine speed data N, the intake air pressure data $P_B$, the engine coolant temperature indicative data Tw, the throttle angle data $\alpha$ are read out. An intake air pressure dependent basic fuel injection amount $Tp_{PB}$ is then derived according to the following equation at a step S2:

$$Tp_{PB}=K_{CON}\times P_B\times\eta_{vo}\times K_{FLAT}\times K_{ALT}\times K_{TA}$$

where $K_{CON}$ is a predetermined constant value;

$\eta_{vo}$ is a basic intake volume efficiency derived on the basis of the intake pressure indicative data $P_B$ by way of map or table look-up against a $\eta_{vo}$ map 21 set in ROM 15;

$K_{FLAT}$ is a correction coefficient derived on the basis of the intake air pressure data $P_B$ and the engine speed data N;

$K_{ALT}$ is an intake air density dependent correction coefficient which is variable dependent on the altitude, and $K_{TA}$ is a temperature dependent correction coefficient.

It should be noted that manner of derivation of the correction coefficients $K_{FLAT}$, $K_{ALT}$, $K_{TA}$ and the basic intake air volume efficiency $\eta_{vo}$ has been disclosed in the co-pending U.S. Patent Application entitled Fuel Supply Control System for Internal Combustion Engine with Improved Response Characteristics to Variation of Induction Pressure, filed on Sept. 21, 1988 and corresponding to co-pending German Patent Application under the same title filed on Sept. 22, 1988 and pending under Application No. P38 32 270.6, which are all assigned to the common owner to the present invention. The disclosure of the above-identified co-pending applications will be herein incorporated by reference for the sake of disclosure.

After deriving the intake air pressure dependent basic fuel injection amount $Tp_{PB}$ at the step S2, discrimination of the engine driving condition is performed at a step S3 to check whether the engine driving condition is an engine start-up transition state, in which an engine start-up enrichment for the fuel injection amount is required, or not.

Figure 7:
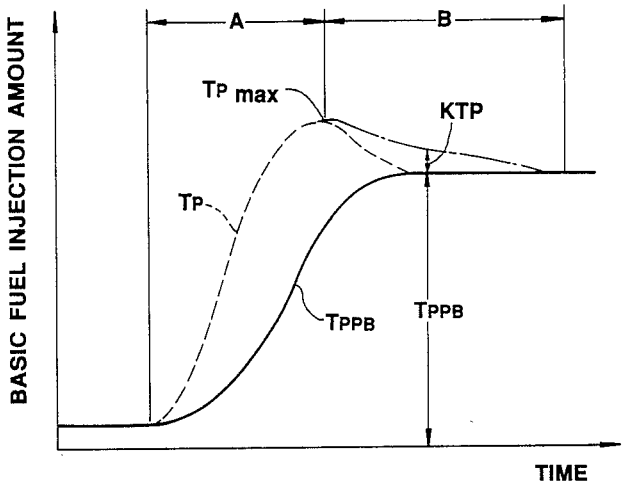
FIG. 7 is a graph showing variation of a basic fuel injection amount during engine transition period.

When the engine driving condition is other than the engine start-up transition state requiring the engine start-up enrichment, a basic fuel injection amount Tp is derived at a step S4 according to the following equation:

$$Tp=(256Tp_{PBnew}-(256-X)\ Tp_{PBold})/X$$

where $Tp_{PBnew}$ is the intake pressure dependent basic fuel injection amount desired at the step S2 in the current execution cycle;

$Tp_{PBold}$ is the intake pressure dependent basic fuel injection amount desired at the step S2 in the immediately preceding execution cycle; and X is a predetermined weighing coefficient. In the equation set out above, if the instantaneous pressure dependent basic fuel injection amount $Tp_{PBnew}$ is same as the older intake air pressure dependent basic fuel injection amount $Tp_{PBold}$, the Tp to be derived becomes equal to $Tp_{PBnew}$ and $Tp_{PBold}$. On the other hand, when the instantaneous intake air pressure dependent basic fuel injection amount $Tp_{PBnew}$ is different from the older intake air pressure dependent basic fuel injection amount $Tp_{PBold}$, such as that in the engine accelerating state, the basic fuel injection amount Tp varies at a greater magnitude as illustrated by broken line in FIG. 7 than the variation magnitude of the intake air pressure dependent basic fuel injection amount $Tp_{PB}$, as shown by the solid line in FIG. 7. Therefore, during engine acceleration transition, the basic fuel injection amount Tp derived through the step S4 becomes greater than the intake air pressure dependent basic fuel injection amount $Tp_{PB}$. By this, the fuel injection spark timing is advanced.

At a step S5, an engine acceleration state indicative flag $FL_{ACC}$ which is to be set in a flag register 22 of CPU 13 is checked. The engine acceleration state indicative flag $FL_{ACC}$ is designed to be set to indicative of transition from the engine accelerating state to steady state after acceleration. Namely, at the initial stage of engine acceleration, the acceleration enrichment demand is relatively great but in the transition period from the acceleration state to the steady state, the acceleration enrichment demand becomes smaller. Therefore, by detecting the acceleration enrichment demand, the transition state from the acceleration state to the steady state can be detected. In the shown embodiment, the transition state from the accelerating state to the steady state is detected by comparing the instantaneous basic fuel injection amount $Tp_{new}$ with an old basic fuel injection amount $Tp_{old}$ derived in the immediately preceding execution cycle, at a step S6.

When the instantaneous basic fuel injection amount $Tp_{new}$ is greater than or equal to the old basic fuel injection amount $Tp_{old}$, the basic fuel injection amount Tp derived at the step S4 in the instant execution cycle is read out at a step S7.

The basic fuel injection amount Tp read at the step S7 is connected by correction coefficient COEF and a battery voltage compensating correction value Ts to derive a fuel injection amount Ti, at a step S15 according to the following equation:

$$Ti = Tp \times COEF + Ts$$

Here, the correction coefficient COEF includes various correction coefficient components to be derived on the basis of various fuel injection amount correction factors, such as air/fuel ratio, the engine coolant temperature and so forth. Derivation of the correction coefficient COEF will be appreciated as known technique which does not require further discussion therefor. At the step S15, the fuel injection amount Ti thus derived is set in the Ti register 19 in the fuel injection control section of the input/output interface 12.

On the other hand, when the instantaneous basic fuel injection amount $Tp_{new}$ is smaller than the old basic fuel injection amount $Tp_{old}$, the acceleration state indicative flag $FL_{ACC}$ is set at a step S8. Thereafter, the basic fuel injection amount Tp derived at the step S4 is compared with the intake air pressure dependent basic fuel injection amount $Tp_{PB}$.

If the basic fuel injection amount Tp is equal to the intake air pressure dependent basic fuel injection amount $Tp_{PB}$, the acceleration indicative flag $FL_{ACC}$ is reset at a step S10. Then, the basis fuel injection amount Tp derived at the step S4 is read out at a step S11. After reading out the basic fuel injection amount Tp, process goes to the step S15 set forth above to derive the fuel injection amount on the basis of the basic fuel injection amount Tp.

Figure 4:
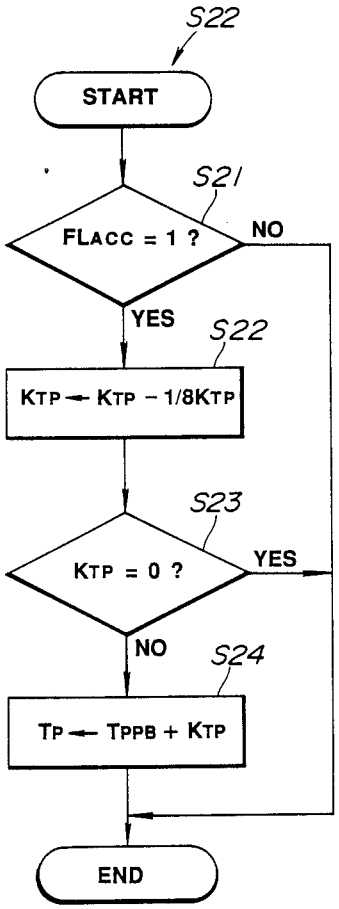
FIG. 4 is a flowchart of a routine for deriving a basic fuel injection amount Tp in an engine transition condition.

On the other hand, when the basic fuel injection amount Tp is not equal to the intake air pressure dependent basic fuel injection amount $Tp_{PB}$, process goes to a step S12 in which a sub-routine shown in FIG. 4 is triggered.

Immediately after starting execution of the sub-routine of FIG. 4, the acceleration state indicative flag $FL_{ACC}$ is checked at a step S21. When the acceleration state indicative flag $FL_{ACC}$ is not set as checked at the step S21, process directly goes to the step S15 to derive the fuel injection amount Ti on the basis of the basic fuel injection amount Tp derived at the step S4. On the other hand, when the acceleration state indicative flag $FL_{ACC}$ is set as checked at the step S21, a fuel decreasing correction coefficient $K_{Tp}$ is derived at a step S22. The fuel decreasing correction coefficient $K_{Tp}$ is calculated according to the following equation:

$$K_{Tp} = K_{Tpold} - \tfrac{1}{8} K_{Tpold}$$

where $K_{Tpold}$ is an old fuel decreasing correction coefficient derived in the immediately preceding execution cycle. The fuel decreasing correction coefficient $K_{Tp}$ derived at the step S22 is checked at a step S23.

It should be noted that the initial value of the fuel decreasing correction coefficient $K_{Tp}$ is set at a value derived as a difference between a maximum value of the basic fuel injection amount $Tp_{max}$ and the instantaneous intake air pressure dependent basic fuel injection amount $Tp_{PB}$. In addition, through the shown embodiment utilizing a fixed value, i.e. $\frac{1}{8}$ for deriving the value to decrease in each execution cycle, it is possible to use a value variable depending upon the $Tp_{max}$ value. Furthermore, it may be possible to use a value variable depending upon the engine coolant temperature, the intake air pressure, an intake air flow rate and so forth, in place of the fixed value, i.e. $\frac{1}{8}$.

When the decreasing correction coefficient $K_{Tp}$ is zero, process directly returns to the routine of FIG. 3. On the other hand, when the fuel decreasing correction coefficient K is not zero as checked at the step S23, the basic fuel injection amount Tp is derived based on the intake air pressure dependent basic fuel injection amount $Tp_{PB}$ and the fuel decreasing correction coefficient $K_{Tp}$ at a step S24 according to the following equation:

$$Tp = Tp_{PB} + K_{Tp}$$

After step S24, process returns to the routine of FIG. 3.

When the engine driving state as checked at the step S3 is the engine starting up state requiring the engine start-up enrichment, process goes to a step S13. At the step S13, the intake air pressure dependent basic fuel injection amount $Tp_{PB}$ derived at the step S2, is read out. Then, an engine start-up enrichment correction coefficient $K_{AS}$ is derived at a step S14. The engine start-up enrichment correction coefficient $K_{AS}$ is set at an initial value which is variable depending upon the engine coolant temperature Tw and is gradually decreased. After deriving the engine start-up enrichment correction coefficient $K_{AS}$ at the step S14, process goes to the step S15. In this case, the fuel injection amount is derived on the basis of the intake air pressure dependent basic fuel injection amount $Tp_{PB}$ according to the following equation:

$$Ti = Tp_{PB} \times COEF \times K_{AS} + Ts$$

After setting the fuel injection amount Ti at the step S15, process goes END and returns to the background job.

As will be seen from the discussion given hereabove, according to the shown process, the improved engine acceleration and better engine response in acceleration can be achieved by providing the basic fuel injection amount Tp which varies at greater magnitude than that of the intake air pressure dependent basic fuel injection amount $Tp_{PB}$ at the initial state of engine acceleration. This process is particularly effective for compensating the fuel amount required for making the inner periphery of the intake manifold wet. Furthermore, in the shown process, by utilizing the basic fuel injection amount Tp derived through the shown process, precise air/fuel ratio control can be achieved even in engine acceleration state to provide better engine acceleration characteristics.

Furthermore, according to the shown routine, the basic fuel injection amount is arithmetically modified during the engine acceleration state, size of a map to be utilized for derivation of engine correction coefficient becomes substantially smaller. This substantially reduces work for setting appropriate values as map date in map. This shorten process time to aid improve response characteristics in the engine control. In addition, according to the invention, the fuel injection amount for the engine start-up transition is derived on the basis of the intake air pressure dependent fuel injection amount and the engine start-up enrichment correction coefficient, abrupt acceleration of the engine upon engine starting-up can be successfully avoided.

Figure 5:
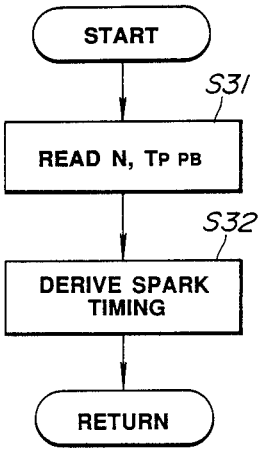
FIG. 5 is a flowchart of a routine for deriving a spark ignition timing.

FIG. 5 shows a routine for setting a spark ignition timing on the basis of the intake air pressure dependent basic fuel injection amount $Tp_{PB}$ and the engine speed data N. In the shown routine, the intake air pressure dependent basic fuel injection amount $Tp_{PB}$ and the engine speed data N are read out at a step S31. Based on the read intake air pressure dependent basic fuel injection amount $Tp_{PB}$ and engine speed data N, spark ignition timing is derived at a step S32. The process of deriving the spark ignition timing is per se well known and thus does not require further discussion.

Though the spark ignition timing derivation process taken in the shown embodiment is per se conventionally known process, higher precision can be achieved by utilizing the intake air pressure dependent basic fuel injection amount $Tp_{PB}$ as the engine load representative data.

Namely, since the intake air pressure dependent basic fuel injection amount $Tp_{PB}$ precisely reflects intake air amount charged in the engine cylinder, the spark ignition timing set based thereon would precisely correspond to the charge volume of the air/fuel mixture. Therefore, engine knocking due to excessively advanced spark ignition timing can be successfully eliminated.

FIG. 6 show s routine for deriving the weighing coefficient X to be utilized in the process of derivation of the basic fuel injection amount Tp in the routine of FIG. 3. The shown routine of FIG. 6 is executed every 10 ms in the shown embodiment and thus in lower frequency than that of the routines of FIGS. 3 and 4.

Figure 8:
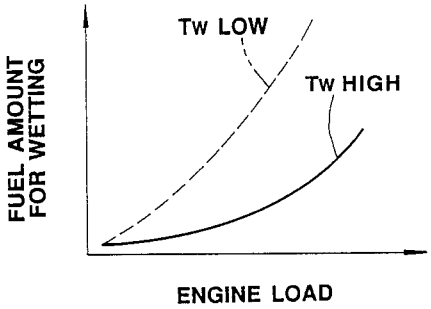
FIG. 8 is a graph showing variation of a required fuel amount for making intake manifold periphery wet in relation to engine load.
Figure 9:
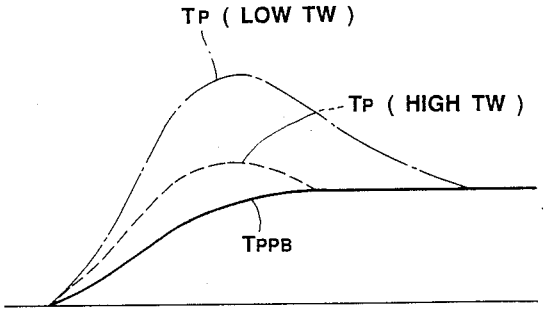
FIG. 9 is a graph showing variation of the basic fuel injection amount in relation to an engine coolant temperature.

Immediately after starting execution, the intake air pressure data $P_B$ and the engine coolant temperature indicative data Tw are read out at a step S41. Based on the engine coolant temperature indicative data Tw, an engine coolant temperature dependent weighing coefficient $X_{Tw}$ is derived at a step S42. As seen from FIG. 8, the amount of fuel required for making the inner periphery of the intake manifold wet is increased according to increasing of the engine load and according to lowering of the engine coolant temperature. Therefore, the engine coolant temperature dependent weighing coefficient $X_{Tw}$ may be decreased according to rising of the engine coolant temperature. By varying the engine coolant temperature dependent weighing coefficient $X_{Tw}$ in a manner set forth above, the basic fuel injection amount Tp in the engine transition varies depending upon the engine coolant temperature. Namely, the basic fuel injection amount Tp is decreased according to rising of the engine coolant temperature Tw as shown in FIG. 9.

At a step S43, an intake air pressure dependent weighing coefficient $X_{PB}$ is derived by map look-up. The intake air pressure dependent weighing coefficient $X_{PB}$ is set to be increased according to increasing of the intake air pressure PB The intake air pressure dependent weighing coefficient $X_{PB}$ derived at the step S43 is multiplied with the engine coolant temperature dependent weighing coefficient $X_{Tw}$ to derive the weighing coefficient.

Therefore, the present invention as described in terms of the preferred embodiment, achieves high response characteristics in the engine transition state and thus fulfills all of the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

For instance, the process of weighing the basic fuel injection amount derived on the basis of the intake air associated engine load data with a weighing coefficient for improving acceleration characteristics can be applied in various systems, for example, the engine control systems disclosed in the co-pending applications listed herebelow:

U. S. patent application Ser. No. 170,360, filed on Mar. 18, 1988, now U.S. Pat. No. 4,844,026, corresponding European Patent Application has been published as European Patent First Publication No. 02 84 054, U.S. patent application Ser. No. 197,847, filed on May 24, 1988, now U.S. Pat. No. 4,903,671.

U.S. patent application Ser. No. 171,022, filed on Mar. 18, 1988, now U.S. Pat. No. 4,911,129 corresponding European Patent Application has been published as European Patent First Publication No. 02 38 18, U.S. patent application Ser. No. 217,861, filed on July 12, 1988, now U.S. Pat. No. 4,951,635 corresponding British and German Patent Applications are pending under Application Nos. 8816552.7 and P38 23 608.7, and U.S. patent application Ser. No. 218,266, filed on July 13, 1988, now U.S. Pat. No. 4,870,935.

The inventions disclosed in the above-mentioned co-pending applications have been all assigned to the common owner to the present invention. The disclosures of the above listed co-pending applications are herein incorporated by reference for the sake of disclosure.

What is claimed is:

1. A control system for an internal combustion engine, comprising:

first sensor means for monitoring an engine driving condition to produce engine driving condition representative data;

second means active in a steady state of said engine for deriving a basic fuel supply amount on the basis of said engine driving condition representative data according to a predetermined first characteristic;

third means for detecting an engine transition state;

fourth means, responsive to said third means detecting said engine transition state, for deriving a basic fuel injection amount according to a predetermined second characteristic, in which a variation rate of said basic fuel injection amount versus variation of said engine driving condition is greater than in said first characteristic;

fifth means for setting a calculated fuel supply amount, said fifth means operating in a first mode for deriving said calculated fuel supply amount on the basis of said basic fuel supply amount derived by said second means and in a second mode, in response to said third means detecting said engine transition state, for deriving said calculated fuel supply amount on the basis of said basic fuel injection amount derived by said fourth means; and sixth means for performing fuel supply for a controlled amount of fuel corresponding to said calculated fuel supply amount set by said fifth means.

2. An engine system as set forth in claim 1, wherein said fourth means varies an engine transition state correction value in relation to said basic fuel supply amount derived by said second means.

3. An engine control system as set forth in claim 2, wherein said fourth means decreases said engine transition state correction value by a given rate.

4. An engine control system as set forth in claim 1, wherein said second means comprises means for deriving basic fuel supply amounts representative data on the basis of said engine driving condition indicative data, and means for deriving said basic fuel supply amount on the basis of said basic fuel amount representative data with a weighting coefficient.

5. An engine control system as set forth in claim 4, wherein said second means arithmetically derives said basic fuel supply amount in such a manner that said basic fuel supply amount becomes equal to said basic fuel supply amount representative data while a difference between instantaneous basic fuel supply amount representative data and preceding basic fuel supply amount representative data derived in an immediately preceding cycle is substantially zero, and said basic fuel supply amount varies in a greater magnitude than that of said basic fuel supply amount representative data when said difference between instantaneous basic fuel supply amount representative data and preceding basic fuel supply amount representative data derived in an immediately preceding cycle is greater than a given value.

6. An engine control system as set forth in claim 5, wherein said second means utilizes a weighing coefficient for arithmetic operation for deriving said basic fuel supply amount which is variable depending upon said engine driving condition.

7. An engine control system as set forth in claim 6, wherein said weighing coefficient is variable depending upon an engine coolant temperature.

8. An engine control system as set forth in claim 5, wherein said fifth means detects an engine start-up condition on the basis of said engine driving condition representative data for utilizing said basic fuel supply representative data as said basic fuel supply amount for deriving said calculated amount.

9. A fuel injection control system for an internal combustion engine, comprising:

first sensor means for monitoring an engine driving condition including a first parameter representative of an intake air related engine load and a second parameter representative of a fuel injection amount correction factor to produce engine driving condition representative data;

second means for deriving a first basic fuel injection amount on the basis of said first parameter;

third means for performing a weighing process for said first basic fuel injection amount with a predetermined weighing coefficient in order to derive a second basic fuel injection amount;

fourth means for detecting an engine acceleration transition state;

fifth means, responsive to said fourth means detecting said engine transition state, for setting an initial value of an engine acceleration transition state correction value which is gradually decreased to zero for modifying said second basic fuel injection amount with said engine transition state correction value to derive a third basic fuel injection amount;

sixth means for setting a calculated fuel injection amount, said fifth means operating in a first mode for deriving said calculated fuel injection amount on the basis of said second basic fuel injection amount derived by said third means and in a second mode, in response to said fourth means detecting said engine acceleration transition state, for deriving said calculated fuel injection amount on the basis of said third basic fuel injection amount; and seventh means for performing fuel injection for a controlled amount of fuel corresponding to sixth means.

10. A fuel injection control system as set forth in claim 9, wherein said fifth means sets said initial value of said engine acceleration transition state correction value at a value corresponding to a difference between a maximum value of said second basic fuel injection amount and an instantaneous value of said first basic fuel injection amount upon detection of said engine acceleration transition state.

11. A fuel injection control system as set forth in claim 10, wherein said fourth means detects engine acceleration transition state in which said engine driving condition transits from an accelerating state to a steady state.

12. A fuel injection control system as set forth in claim 11, wherein said third means arithmetically derives said second basic fuel injection amount in such a manner that said second basic fuel injection amount becomes equal to said first basic fuel injection amount while a difference between an instantaneous first basic fuel injection amount and a preceding first basic fuel injection amount derived in an immediately preceding cycle is zero, and that said second basic fuel injection amount varies in a greater magnitude than that of said first basic fuel injection amount when said difference between said instantaneous first basic fuel injection amount and said preceding first basic fuel injection amount is greater than zero.

13. A fuel injection control system as set forth in claim 9, wherein said weighing coefficient is variable depending upon an engine coolant temperature.

14. A fuel injection control system as set forth in claim 9, wherein said weighing coefficient is variable depending upon said first parameter.

15. A fuel injection control system as set forth in claim 3, wherein said weighing coefficient is also variable depending upon said first parameter.

16. A fuel injection control system as set forth in claim 9, wherein said sixth means detects an engine start-up condition on the basis of said engine driving condition representative data for utilizing said basic fuel injection representative data as said basic fuel injection amount for deriving said calculated fuel injection amount.

17. A fuel injection control system for an internal combustion engine, comprising:

first sensor means for monitoring an engine driving condition including a first parameter representative of an intake air pressure and a second parameter representative of a fuel injection correction factor to produce engine driving condition representative data;

second means for deriving a first basic fuel injection amount on the basis of said first parameter and a correction value derived on the basis of said second parameter;

third means for performing a weighing process for said first basic fuel injection amount with a predetermined weighing coefficient in order to derive a second basic fuel injection amount, said third means being responsive to an engine acceleration state for increasing a value of said second basic fuel injection amount at a greater rate than an increasing rate of a value of said first basic fuel injection amount;

fourth means for detecting an engine acceleration transition state from an engine accelerating state to a steady state;

fifth means, responsive to said fourth means for detecting said engine acceleration transition acceleration transition state correction value which is gradually decreased to zero for modifying said basic fuel injection amount with said engine transition state correction value to derive a third basic fuel injection amount;

sixth means for setting a calculated fuel injection amount, said sixth means operating in a first mode for deriving said calculated fuel injection amount on the basis of said second basic fuel injection amount derived by said third means and in a second mode, in response to said fourth means detecting said engine acceleration transition state, for deriving said calculated fuel injection amount on the basis of said third basic fuel injection amount; and seventh means for performing fuel injection for a controlled amount of fuel corresponding to said calculated fuel injection amount set by said sixth means.

18. A fuel injection control system as set forth in claim 17, wherein said fifth means sets said initial value of said engine acceleration transition state correction value at a value corresponding to a difference between a maximum value of said second basic fuel injection amount and an instantaneous value of said first basic fuel injection amount upon detection of said engine acceleration transition state.

19. A fuel injection control system as set forth in claim 18, wherein said third means arithmetically derives said second basic fuel injection amount in such a manner that said second basic fuel injection amount becomes equal to said first basic fuel injection amount while a difference between an instantaneous first basic fuel injection amount and a preceding first basic fuel injection amount derived in an immediately preceding cycle is zero, and that said second basic fuel injection amount varies in a greater magnitude than that of said first basic fuel injection amount when said difference between said instantaneous first basic fuel injection amount and said preceding first basic fuel injection amount is greater than zero.

20. A fuel injection control system as set forth in claim 17, wherein said weighing coefficient is variable depending upon an engine coolant temperature.

21. A fuel injection control system as set forth in claim 17, wherein said weighing coefficient is variable depending upon said first parameter.

22. A fuel injection control system as set forth in claim 20, wherein said weighing coefficient is also variable depending upon said first parameter.

23. A fuel injection control system as set forth in claim 17, wherein said sixth means detects an engine start-up condition on the basis of said engine driving condition representative data for utilizing said basic fuel injection representative data as said basic fuel injection amount for deriving said calculated injection amount.

24. A spark ignition timing control system for an internal combustion engine, comprising:

first sensor means for monitoring an engine driving condition including a first parameter representative of an intake air pressure, a second parameter representative of an engine speed and a third parameter representative of a preselected correction factor to produce data representative of an engine driving condition;

second means for deriving a first basic fuel injection amount on the basis of said first parameter and a correction value derived on the basis of said third parameter;

third means for performing a weighing process for said basic fuel injection amount with a predetermined weighing coefficient in order to derive a second basic fuel injection amount, said third means being responsive to an engine acceleration state for increasing a value of said second basic fuel injection amount at a greater rate than an increasing rate of a value of said first basic fuel injection amount; and fourth means for setting a spark ignition timing on the basis of said first basic injection amount as an engine load representative parameter and said second parameter monitored by said sensor means.

25. A control system for an internal combustion engine, comprising:

first sensor means for monitoring an engine driving condition including a first parameter representative of an intake air pressure, a second parameter representative of an engine speed, and a third parameter representative of a preselected fuel supply correction factor to produce data representative of an engine driving condition;

second means for deriving a first basic fuel supply amount on the basis of said first parameter and a correction value derived on the basis of said third parameter;

third means for performing a weighing process for said basis fuel supply amount with a predetermined weighing coefficient in order to derive a second basic fuel supply amount, said third means being responsive to an engine acceleration state for increasing a value of said second basic fuel supply amount at a greater rate than an increasing rate of a value of said first basic fuel supply amount;

fourth means for detecting an engine transition state;

fifth means, responsive to said fourth means detecting said engine transition state, for modifying said second basic fuel supply amount with a given engine transition state correction value to derive a third basic fuel supply amount;

sixth means for setting a calculated fuel supply amount, said fifth means operating in a first mode for deriving said calculated fuel supply amount on the basis of said second basic fuel supply amount and in a second mode which is triggered in response to said fourth means detecting said engine transition state, for deriving said calculated fuel supply amount on the basis of said third basic fuel supply amount;

seventh means for performing fuel supply for a controlled amount of fuel corresponding to said calculated fuel supply amount set by said sixth means;

eighth means for setting a spark ignition timing on the basis of said first basic fuel supply amount as an engine load representative parameter and said second parameter monitored by said sensor means.

26. A control system for an internal combustion engine, comprising:

first sensor means for monitoring an engine driving condition to produce engine driving condition representative data;

second means for deriving a basic fuel supply amount on the basis of said engine driving condition representative data;

third means for detecting an engine transition state;

fourth means, responsive to said third means detecting said engine transition state, for deriving the basic fuel supply amount on the basis of the basic fuel supply amounts derived in the current and immediately preceding derivation timing;

fifth means for setting a fuel supply amount, said fifth means operating in a first mode for deriving said fuel supply amount on the basis of said basic supply amount derived by said second means and in a second mode, in response to said third means detecting said engine transition state, for deriving said fuel supply amount on the basis of said basic fuel supply amount derived by said fourth means; and sixth means for performing fuel supply for a controlled amount of fuel corresponding to the fuel supply amount set by said fifth means.

27. A control system for an internal combustion engine, comprising;

first sensor means for monitoring an engine driving condition to produce engine driving condition representative data;

second means for deriving a basic fuel supply amount on the basis of said engine driving condition representative data;

third means for detecting an engine transition state;

fourth means, responsive to said third means detecting said engine transition state, for modifying said basic fuel supply amount with a given engine transition state correction value;

fifth means for setting a calculated fuel supply amount, said fifth means operating in a first mode for deriving said calculated fuel supply amount on the basis of said basic fuel supply amount derived by said second means and in a second mode, in response to said third means detecting said engine transition state, for deriving said calculated fuel supply amount on the basis of said basic fuel supply amount modified by said fourth means; and sixth means for performing fuel supply for a controlled amount of fuel corresponding to said calculated fuel supply amount set by fifth means, wherein said second means comprises means for deriving basic fuel supply amount representative data on the basis of said engine driving condition representative data, and means for deriving said basic fuel supply amount on the basis of said basic fuel amount representative data with a weighing coefficient.

28. An engine control system as set forth in claim 27, wherein said fourth means varies an engine transition state correction value in relation to said basic fuel supply amount derived by said second means.

29. An engine control system as set forth in claim 28, wherein said fourth means deceases said engine transition state correction value by a given rate.

* * * * *